US011692684B2

(12) United States Patent
Levine

(10) Patent No.: US 11,692,684 B2
(45) Date of Patent: Jul. 4, 2023

(54) FILTERING ASSEMBLY FOR ENHANCING LIGHTING FROM A LUMINAIRE

(71) Applicant: Adam Richard Levine, Chatsworth, CA (US)

(72) Inventor: Adam Richard Levine, Chatsworth, CA (US)

(73) Assignee: DESIGNSPARK, LLC, Chatsworth, CA (US)

( * ) Notice: Subject to any disclaimer, the term of this patent is extended or adjusted under 35 U.S.C. 154(b) by 0 days.

(21) Appl. No.: 17/347,157

(22) Filed: Jun. 14, 2021

(65) Prior Publication Data

US 2022/0260231 A1 Aug. 18, 2022

Related U.S. Application Data

(60) Provisional application No. 63/150,920, filed on Feb. 18, 2021.

(51) Int. Cl.
*F21V 1/10* (2006.01)
*F21V 17/06* (2006.01)
*F21V 1/18* (2006.01)

(52) U.S. Cl.
CPC ..... *F21V 1/10* (2013.01); *F21V 1/18* (2013.01); *F21V 17/06* (2013.01)

(58) Field of Classification Search
CPC ..... F21V 1/08; F21V 1/10; F21V 1/18
See application file for complete search history.

(56) References Cited

U.S. PATENT DOCUMENTS 4,602,321 A * 7/1986 Bornhorst ..... F21V 9/40 362/268
4,634,222 A 1/1987 Critten
4,709,311 A * 11/1987 Bornhorst ..... F21V 17/02 362/280
4,934,793 A 6/1990 Klein
5,093,769 A * 3/1992 Luntsford ..... F21V 9/04 362/267
5,144,540 A * 9/1992 Hayes ..... F21S 10/02 362/268
5,510,969 A * 4/1996 Rodger ..... F21V 11/18 362/281
6,808,290 B2 10/2004 Lee
(Continued)

*Primary Examiner* — Zheng Song
(74) *Attorney, Agent, or Firm* — Vincent G. LoTempio

(57) ABSTRACT

A filtering assembly for enhancing lighting from a luminaire serves as a lighting filter that includes one or more stackable and interchangeable filter devices. The filter devices are configured to detachably couple to a luminaire, and custom block a portion of the light transmitted from the luminaire. This enables a uniquely shaped transmission of light and/or removing unwanted spills and or glare emanating from the luminaire. The filter devices comprise a body that defines a clear section that allows full passage of light from the underlying luminaire, and an opaque section that allows partial or no passage of light. The filter devices also comprise an outer rim having a friction enhancing material that enables a snug engagement with the perimeter recess forming in the luminaire. The friction enhancing material of the outer rim restricts slippage when stacking multiple filter devices, and with the inside perimeter recess formed in the luminaire.

19 Claims, 5 Drawing Sheets

(56) References Cited

U.S. PATENT DOCUMENTS

| | | | | |
|---|---|---|---|---|
| 2008/0043468 | A1* | 2/2008 | Kennedy | G02B 27/20 362/255 |
| 2012/0113648 | A1* | 5/2012 | Jacksen | F21V 11/18 362/277 |
| 2016/0363289 | A1* | 12/2016 | Hansen | G02B 26/02 |
| 2019/0113184 | A1* | 4/2019 | Burgess | G02B 5/0278 |
| 2020/0200365 | A1* | 6/2020 | Zhang | F21V 14/08 |

* cited by examiner

FILTERING ASSEMBLY FOR ENHANCING LIGHTING FROM A LUMINAIRE

CROSS REFERENCE OF RELATED APPLICATIONS

This application claims the benefits of U.S. provisional application No. 63/150,920, filed Feb. 18, 2021 and entitled "A SERIES OF STACKABLE LIGHTING ACCESSORIES THAT RESIDE IN A LUMINAIRE ALLOWING THE OPENING TO BE REDUCED TO CUT OUT A PORTION OF THE LIGHT TO SHIELD UNWANTED SPILL OR GLARE. THESE DISCS ARE AVAILABLE IN ALL SIZES AND SHAPES.", which provisional application is incorporated by reference herein in its entirety.

FIELD OF THE INVENTION

The present invention relates generally to a filtering assembly for enhancing lighting from a luminaire. More so, the present invention relates to a lighting filter that includes one or more stackable and interchangeable filter devices that detachably couple to a luminaire to custom block a portion of the light transmitted from the luminaire for obtaining a uniquely shaped transmission of light and/or removing unwanted spills and or glare emanating from the luminaire.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In considering the lighting requirements for an area, among the more important considerations are the need for individual task lighting, for example, for surfaces approximately two and half feet above the floor, and the need to provide some ambient lighting. The latter is desirable both from a safety standpoint and for psychological reasons, as will be discussed below. In many lighting fixtures (or "luminaires") that embody one or more LEDs capable of producing light at particular color points and color temperatures, it may be desirable to appropriately mix the light output of such LEDs prior to the light output exiting the LED-based lighting fixture.

Typically, with recessed luminaires there is often a time where a vertical surface is too close to a luminaire and a light scallop (spill) appears and it is typically unwanted. The luminaire device placed inside the luminaire cuts out unwanted light. With this device only the part of the light that is unwanted can be cut out of the beam and the remainder of light can shine through.

Other proposals have involved altering the light emitted from luminaires. The problem with these lighting devices is that they do not allow for framing the light in a desired lighting pattern. Also, the lighting devices do not mount efficiently onto the luminaire. Even though the above cited lighting devices meets some of the needs of the market, a filtering assembly for enhancing lighting from a luminaire that includes one or more stackable and interchangeable filter devices that detachably couple to a luminaire to custom block a portion of the light transmitted from the luminaire for obtaining a uniquely shaped transmission of light and/or removing unwanted spills and or glare emanating from the luminaire, is still desired.

SUMMARY

Illustrative embodiments of the disclosure are generally directed to a filtering assembly for enhancing lighting from a luminaire. The filtering assembly serves as a lighting filter that includes one or more stackable and interchangeable filter devices. The filter devices are configured to detachably couple to a luminaire. While coupled thereto, the filter devices serve to custom block a portion of the light transmitted from the luminaire. This enables a uniquely shaped transmission of light and/or removing unwanted spills and or glare emanating from the luminaire.

In some embodiments, the filter devices comprise a body that defines a clear section that allows full passage and emission of the light from the underlying luminaire, and an opaque section that allows partial or no passage of light. The filter devices also comprise an outer rim having a friction enhancing material that enables a snug engagement with the perimeter recess forming in the luminaire. The friction coefficient of the outer rim of the filter device is greater than the friction coefficient in the perimeter recess of the luminaire. Further, the friction enhancing material of the outer rim facilitates stacking multiple filter devices inside the perimeter recess forming in the luminaire.

In one aspect, a filtering assembly for enhancing lighting from a luminaire, comprises:

multiple stackable and interchangeable filter devices including:

- a body having a clear section configured to allow full passage of light, the body further having an opaque section configured to allow partial or no passage of light,
- whereby the filter devices have a differently sized and dimensioned clear sections and opaque sections; and
- an outer rim disposed along the periphery of the body, the outer rim having a friction enhancing material, the friction enhancing material defined by a friction coefficient,
- whereby the friction enhancing material restricts slippage between a stacked arrangement of filter devices.

In another aspect, at least one of the filter devices overlays a luminaire, the luminaire comprising a light source configured to transmit light, the luminaire comprising a lens having a recessed perimeter, the lens enabling at least partial passage of the light.

In another aspect, the body of the filter devices is disposed in a parallel, adjacent relationship with the luminaire.

In another aspect, the outer rim of the filter devices engages the recessed perimeter of the luminaire.

In another aspect, the friction enhancing material of the outer rim helps restrict slippage with the recessed perimeter of the luminaire.

In another aspect, multiple filter devices stack onto the luminaire.

In another aspect, the light emitting from the luminaire is at least partially blocked by the opaque section of the filter devices.

In another aspect, the light emitting from the luminaire is allowed through the clear section of the filter devices.

In another aspect, the body comprises a glass or a plastic material.

In another aspect, the body includes at least one of the following shapes: a circular shape, a square shape, a rectangular shape, and an irregular shape.

In another aspect, the body is flat.

In another aspect, the body is concave or convex.

In another aspect, the clear section is concentrically disposed inside the opaque section of the body.

In another aspect, the opaque section comprises a white color or a black color.

In another aspect, the friction enhancing material comprises cork.

In another aspect, the friction coefficient of the cork is about 0.35μ.

One objective of the present invention is to block a portion of the light transmitted from the luminaire to allow a uniquely shaped transmission of light and/or removing unwanted spills and or glare emanating from the luminaire.

An exemplary objective is to customize the light emitting from a luminaire with minimal costs and equipment.

Another objective is to allow for custom shielding of light from the luminaire.

Another objective is to stack multiple filter devices on the luminaire to achieve different combinations of blocked light.

Yet another objective is to provide a friction enhancing outer rim that resists slippage between filter devices and stacked filter devices.

Yet another objective is to provide an outer rim to the filtering device that prevents light leakage from the edge of the luminaire.

Additional objectives are to provide an inexpensive to manufacture filtering assembly for enhancing lighting from a luminaire.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
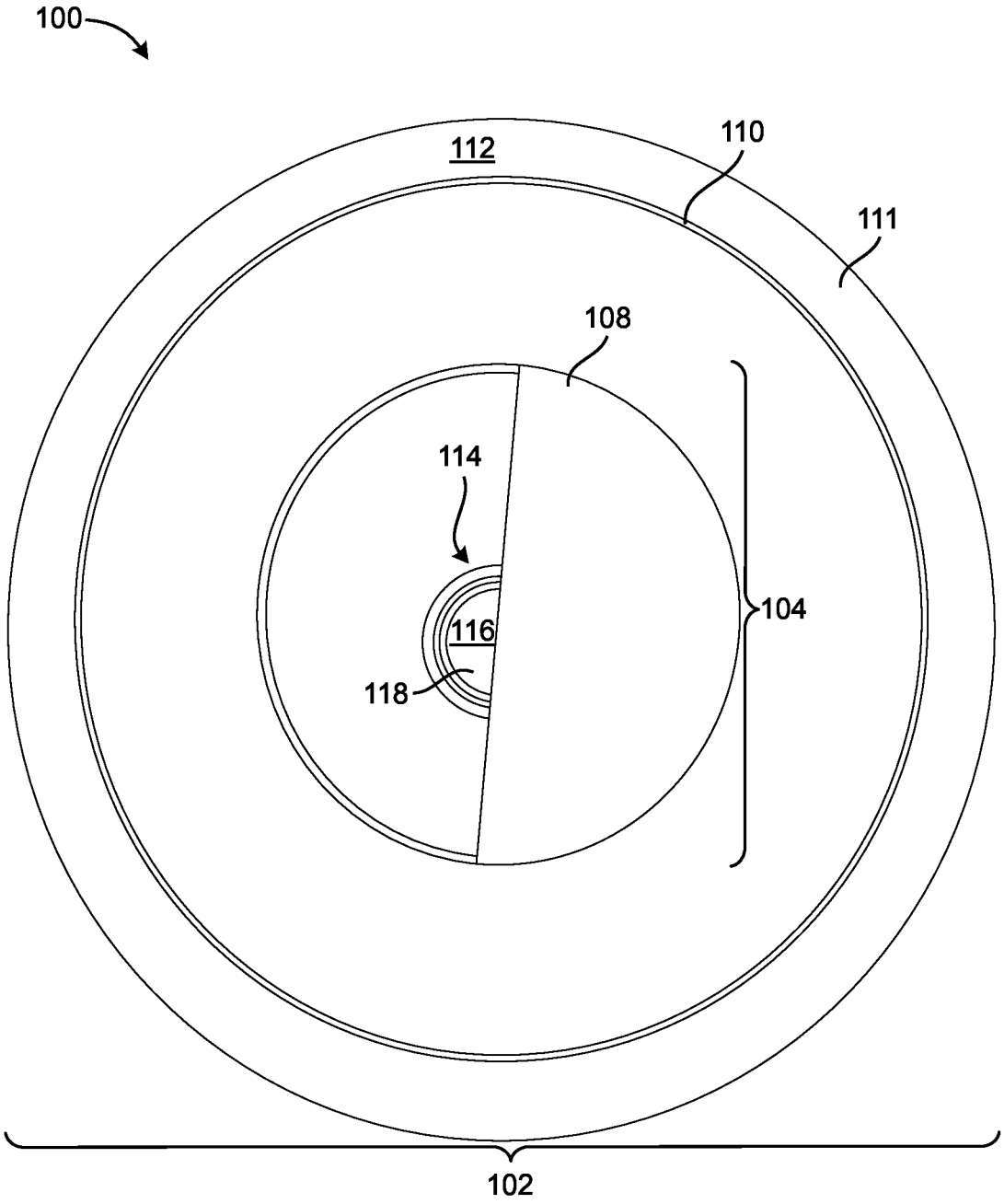
FIG. 1 illustrates a perspective view of an exemplary filtering assembly for enhancing lighting from a luminaire, showing the opaque section and the clear section, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A filtering assembly 100 for enhancing lighting from a luminaire is referenced in FIGS. 1-6. The filtering assembly 100, hereafter "assembly 100" is operable with a luminaire 114, or other lighting fixture, to custom-block, or selectively block and allow passage of light that emits from the luminaire 114. Assembly 100 has multiple sections that enable and restrict passage of light emitting from luminaire 114. In this manner, the optics of the luminaire 114 are allowed to operate status quo, while the light emitting therefrom is selectively blocked to create unique lighting patterns and remove unwanted spills and glare emanating from the luminaire 114.

Thus, by utilizing a single or a combination of assemblies with different blocking capabilities, customizable light shielding is possible. The resultant is that the light being transmitted from the luminaire 114 emits from selected sections of the luminaire 114. This can be used for special optics effects, and for removing unwanted spills and or glare emanating from the luminaire 114. Assembly 100 also has a unique mounting rim that fits into the recessed perimeter 202 of the luminaire 114 that helps prevent slippage or overheating when in contact with luminaire 114.

In some embodiments, luminaire 114 may include a lighting fixture, a lamp, a flashlight, a ceiling light, a spotlight, and any structure that emits light. Luminaire 114 may include a light source 118 configured to transmit light. Light source 118 can be a lamp or LED, for example. Luminaire 114 also comprises a lens 116. Lens 116 is configured to overlay light source 118 and enable at least partial passage of the light. Lens 116 can be flat, concave, or convex. Lens 116, in order to be operable with assembly 100, may require a recessed perimeter 202, into which outer rim 110 of filter devices 102 rest. However, in alternative embodiments, a recessed perimeter 202 is not required, as outer rim 110 can rest onto a flat perimeter, or even a protruding perimeter. Though fastening means may be required to couple filter devices 102 thereto.

Looking now at FIG. 1, assembly 100 comprises multiple stackable and interchangeable filter devices 102. Filter devices 102 include a body 104, which serves as the central functional component. Body 104 may include a glass or plastic component that is flat, concave, or convex. In general, body 104 overlays a lens 116 of the luminaire 114. In some embodiments, the body 104 may include, without limitation, a circular shape, a square shape, a rectangular shape, and an irregular shape. As illustrated, body 104 is disc-shaped.

Figure 2:
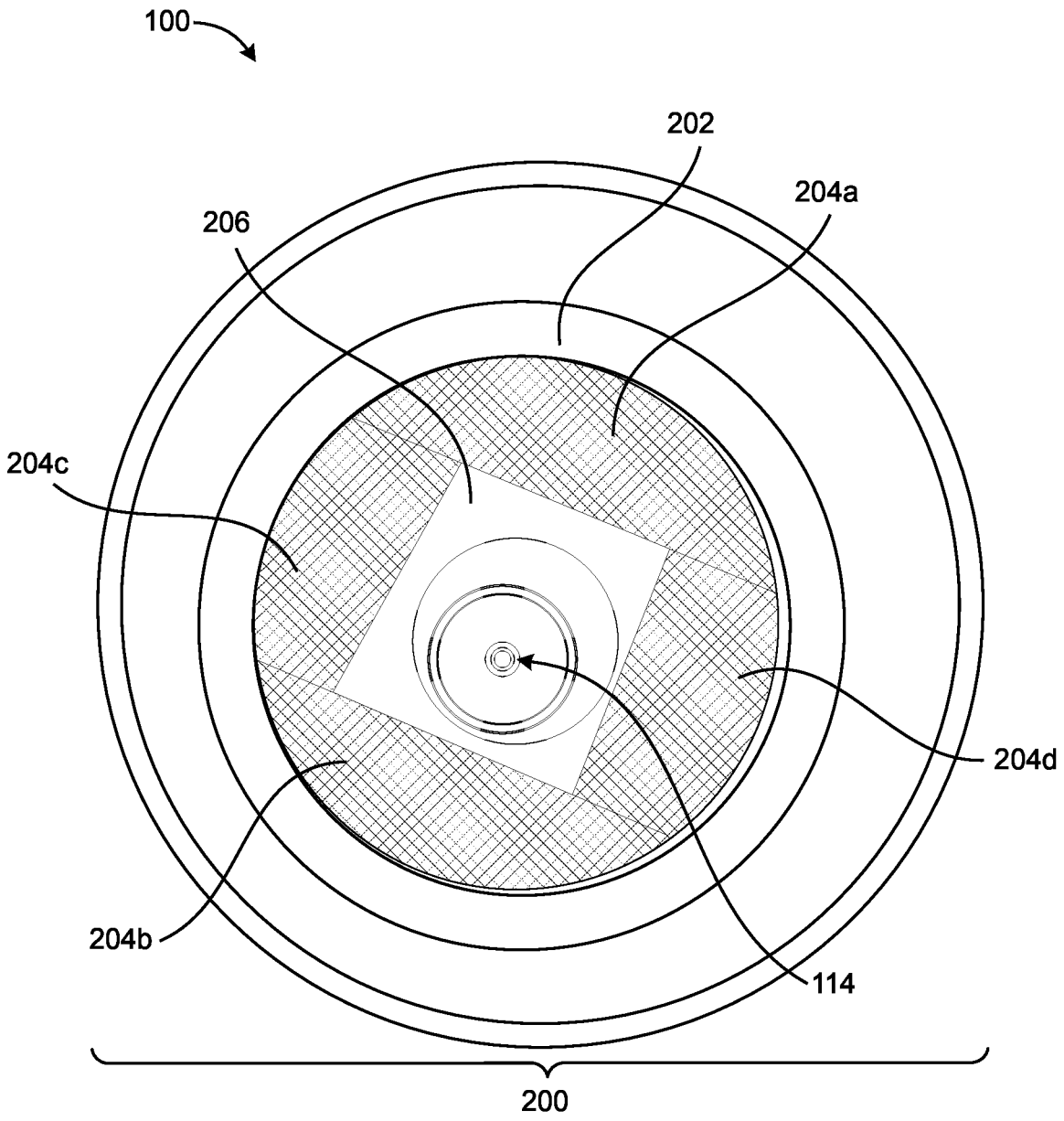
FIG. 2 illustrates a perspective view of a second embodiment of the filtering assembly, showing four outer opaque sections and a central clear section of the body, in accordance with an embodiment of the present invention.
Figure 3:
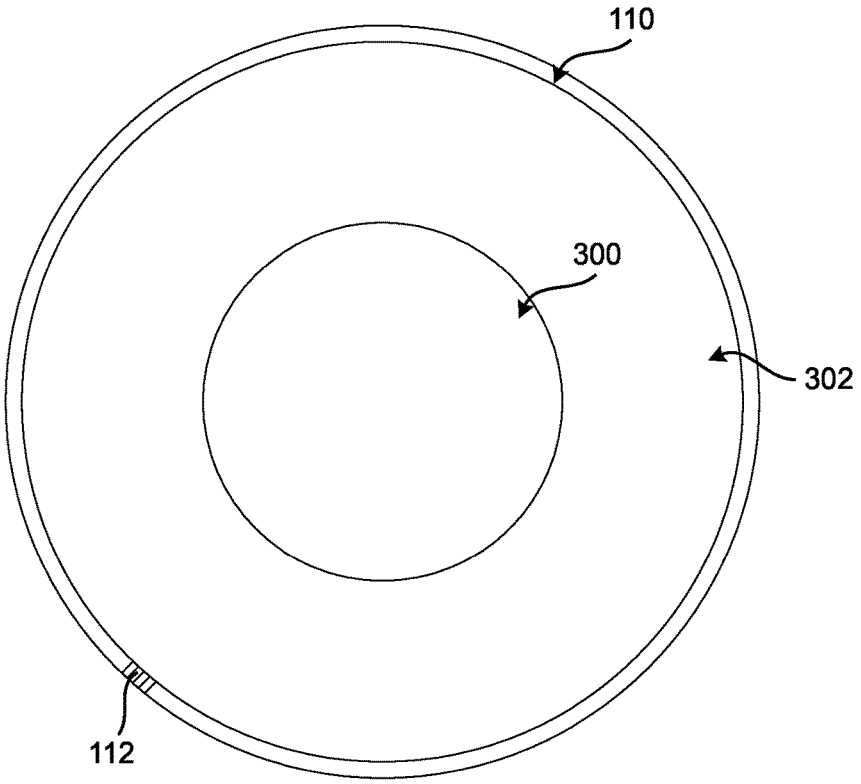
FIG. 3 illustrates a perspective view of a third embodiment of the filtering assembly, showing a circular outer outer opaque section, and a circular central clear section of the body, in accordance with an embodiment of the present invention.

As shown in FIG. 2, the body 104 comprises at least one portion that is a clear section 206, and at least one portion that is an opaque section 108. Clear section 206 is configured to allow full passage of light. Opaque section 108 is configured to allow partial or no passage of light. In essence, the shape and dimension of clear section 206 and opaque section 108 can be different. Thus, the light pattern can be customized based on the shape, position, and size of opaque section 108 in relation to clear section 206 of the body 104. In alternative embodiments, clear section 206 is a louver with light diffraction capacity. Clear section 206 may also be rippled, or have other irregular patterns to help diffuse light. Clear section 206 may also be colored, so as to change color of emitted light.

The shape and size of the respective sections dictate the amount and pattern of light being emitted from the luminaire 114. Thus, the unique configuration of the filter devices 102 is that of differently sized and dimensioned clear sections and opaque sections. In one embodiment, the opaque section 108 comprises a white color or a black color. However, other parameters of opaque section may also be used in other embodiments.

For example, a first filter device 102 can have a large central clear section 206, and a narrow outer opaque section 108 (See FIG. 1). And a second filter device 200 can have four outer opaque sections 204*a*, 204*b*, 204*c*, 204*d* and a central clear section (FIG. 2). In yet another embodiment, shown in FIG. 3, clear section 300 is concentrically disposed inside opaque section 302 of the body of filter device. In any manner, each filter device 102, independently coupled to the luminaire 114, enables passage of a different pattern and intensity of light. Further, when the filter assemblies 102, 200 are stacked, additional unique lighting patterns can be formed.

Figure 4:
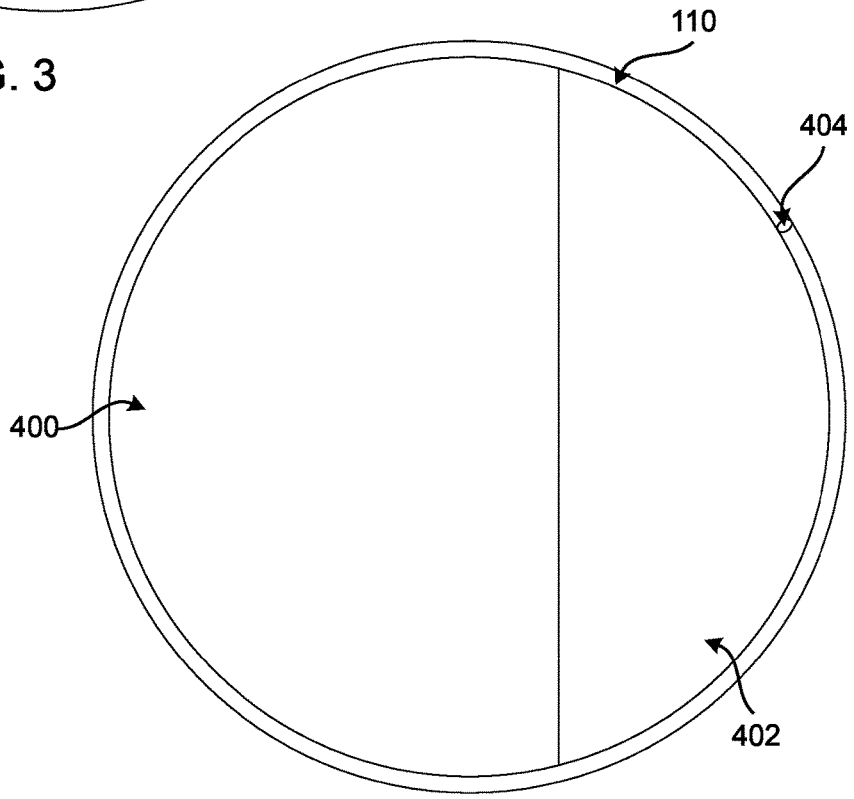
FIG. 4 illustrates a perspective view of a fourth embodiment of the filtering assembly, showing a large opaque section, and a small clear section of the body, in accordance with an embodiment of the present invention.
Figure 5:
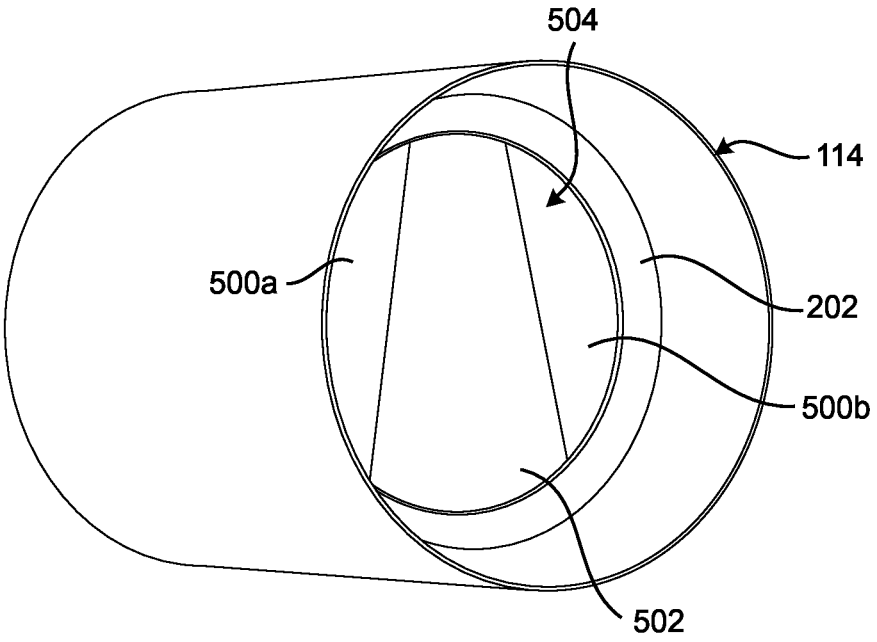
FIG. 5 illustrates a perspective view of two filters coupled to a luminaire, in accordance with an embodiment of the present invention.

In another embodiment, shown in FIG. 4, clear section 400 comprises ⅔ of the area of the body 104, and the opaque section 402 comprises ⅓ of the area of the body 104. In yet other embodiments, multiple filter devices 102 having differently sized and dimensioned clear and opaque sections which can be stacked to achieve additional light blockage capacity; and thereby different lighting patterns emitted from the luminaire 114. The lighting advantages of such selective light blocking are numerous. For example, when stacking multiple filter devices 102 into the luminaire 114, a "frame" of light is created in the luminaire 114.

Thus, if a picture onto which the light is being shone is square; and the light from a round luminaire 114 is shined at the picture, a circular light pattern forms on the picture. However, if the filter device coupled to the luminaire has a square-shaped clear section 206 with a square opaque section 108 outside the clear section 206. This could be achieved by adding four filter devices 102 stacked atop each other, with each filter device having the square-shaped opaque section 108.

Figure 6:
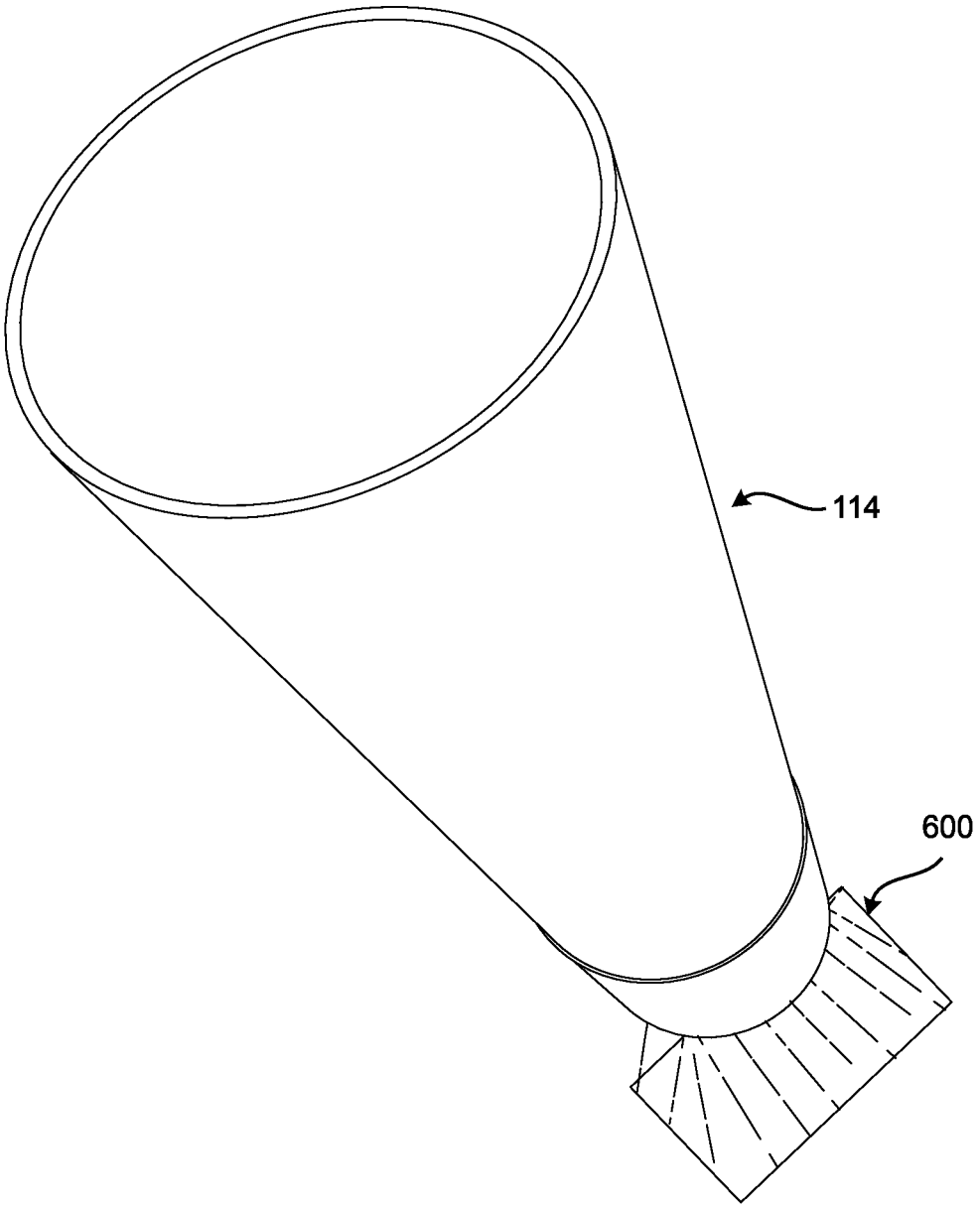
FIG. 6 illustrates a perspective view of a luminaire emitting a rectilinear light pattern based on an attached filter device, in accordance with an embodiment of the present invention.

As is illustrated, the emitted light pattern is dependent on the type of filter device attached thereto. For example, FIG. 6 shows a standard rectilinear light pattern 600 emitting from luminaire 114. Such a rectilinear light pattern 600 could be a luminaire 114 with no filter device attached, or with a circular-shaped filter device attached thereto. Those skilled in the art will recognize that this concept is extremely lucrative for luminaire 114 manufacturers that don't make framing projectors. This is since the manufacturer can add a series of filter devices 102 to their product line to make any recessed fixture a framing projector at lower costs.

As discussed above, filter devices 102 detachably couple to luminaire 114 at the periphery; and specifically, through the outer rim 110 that engages the recessed perimeter 202 of the luminaire 114. In one possible embodiment, the body 104 of the filter devices 102 is disposed in a parallel, adjacent relationship with the luminaire 114. In this configuration, the outer rim 110 of the filter devices 102 engages the recessed perimeter 202 of the luminaire 114. In one possible embodiment, a heat-resistant, friction enhancing material 112 is adhered to bottom edge of outer ring in a blade configuration to minimize movement and light leaks.

Thus, looking again at FIG. 1, filter devices 102 have an outer rim 110 that facilitates mounting and restricts slippage of the filter devices 102 when coupled to the luminaire 114, or when multiple filter devices 102 are stacked into the recessed perimeter 202 of luminaire 114. Specifically, outer rim 110 is disposed along the periphery of the body 104. Outer rim 110 is defined by a friction enhancing material 112. In one possible embodiment, the friction enhancing material 112 is cork. However, other materials may also be used for the outer rim 110.

In some embodiments, friction enhancing material 112 is defined by a friction coefficient. Friction coefficient measures the capacity of the outer rim 110 to slide across an adjacent outer rim 110, or the recessed perimeter 202 of the luminaire 114. Specifically, the friction enhancing material 112 restricts slippage between a stacked arrangement of filter devices 102, as each outer rim 110. Friction enhancing material 112 enables a snug engagement with the perimeter recess forming in the luminaire 114. In one non-limiting embodiment, the friction coefficient of the cork is about 0.35μ.

In one embodiment, friction coefficient of outer rim 110 of filter device is greater than friction coefficient in the recessed perimeter 202 of luminaire 114. Further, the friction enhancing material 112 of outer rim 110 facilitates stacking multiple filter devices 102 inside recessed perimeter 202 that forms about the periphery of luminaire 114. Thus, utilizing a single or a combination of multiple filter devices 102 on top of the luminaire 114, with each filter device having different configurations of clear sections and opaque sections creates different blocking capabilities. This allows for custom shielding of the light emitting from the luminaire 114. Filter devices 102 can also be coupled to the luminaire 114 to produce a framing projector out of a recessed luminaire 114, which can reduce costs.

In conclusion, filtering assembly 100 enhances lighting from a luminaire 114 by serving as a lighting filter that includes one or more stackable and interchangeable filter devices 102. The filter devices 102 are configured to detachably couple to a luminaire 114, and custom block a portion of the light transmitted from the luminaire 114. This enables a uniquely shaped transmission of light and/or removing unwanted spills and or glare emanating from the luminaire 114. The filter devices 102 comprise a body 104 that defines a clear section 206 that allows full passage of light from the underlying luminaire 114, and an opaque section 108 that allows partial or no passage of light.

Filter devices 102 also comprise an outer rim 110 having a friction enhancing material 112 that enables a snug engagement with the perimeter recess forming in the luminaire 114. The friction enhancing material 112 of the outer rim 110 restricts slippage when stacking multiple filter devices 102, and with the inside perimeter recess formed in the luminaire 114. Assembly 100 is configured to be placed in a luminaire 114 of any type, mounting condition, source, or orientation at the closest bottom concealed edge allowing the light that has passed through the reflector and lens 116 to hit body 104 of filter devices 102 blocks the light as needed, only allowing the desired light to pass through. A trim 111 may cover the outer rim 110.

A process for manufacturing filtering devices is dependent on the material used for the light source 118 of the luminaire 114, the device can be 3D printed, stamped, water jet cut, plasma cut out of materials. Each disc will be available in standard RAL colors as well as any custom finish as requested. The friction enhancing material 112 will be placed with adhesive that can withstand high temperatures. All elements are necessary except the additional friction material which is applied during finishing is optional. In alternative embodiments, a series of micro ball bearings 404 could be added to an outer rim 110 of the filter devices 102 to allow the body 104 to rotate freely about the recessed perimeter of the luminaire 114. If multiple filter devices 102 are stacked onto each other they can form a framed aperture to allow for shaping the beam of light into different shapes.

These and other advantages of the invention will be further understood and appreciated by those skilled in the art by reference to the following written specification, claims and appended drawings. Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An assembly for enhancing lighting, the assembly comprising:

multiple stackable and interchangeable filtering devices wherein each filtering device includes a body having a clear section and an opaque section, whereby the clear section and the opaque section have different sizes and dimensions; and wherein each filtering device include an outer rim having a friction enhancing material wherein the friction enhancing material defines a friction coefficient configured to restrict slippage by the outer rim between a stacked arrangement of filter devices.

2. The assembly of claim 1, wherein at least one of the filter devices overlays a luminaire, the luminaire comprising a light source configured to transmit light, the luminaire comprising a lens having a recessed perimeter, the lens enabling at least partial passage of the light.

3. The assembly of claim 2, wherein the body of the filter devices is disposed in a parallel, adjacent relationship with the luminaire.

4. The assembly of claim 3, wherein the outer rim of the filter devices engages the recessed perimeter of the luminaire.

5. The assembly of claim 4, wherein the friction enhancing material of the outer rim helps restrict slippage with the recessed perimeter of the luminaire.

6. The assembly of claim 5, wherein multiple filter devices stack onto the luminaire.

7. The assembly of claim 6, wherein the light emitting from the luminaire is at least partially blocked by the opaque section of the filter devices, and the light emitting from the luminaire is allowed through the clear section of the filter devices.

8. The assembly of claim 2, further comprising multiple micro ball bearings disposed along the outer rim, the micro ball bearings enabling the body to rotate freely about the lens of the luminaire.

9. The assembly of claim 1, wherein the clear section is configured to allow full passage of light.

10. The assembly of claim 9, wherein the body is flat and comprises a glass or a plastic material.

11. The assembly of claim 1, wherein the opaque section is configured to at least partially restrict passage of light.

12. The assembly of claim 1, wherein the outer rim is disposed along a periphery of the body.

13. The assembly of claim 1, wherein the body includes at least one of the following shapes: a circular shape, a square shape, a rectangular shape, concave or convex, and an irregular shape.

14. The assembly of claim 1, wherein the clear section is concentrically disposed inside the opaque section of the body.

15. The assembly of claim 1, wherein the friction enhancing material comprises cork, wherein the cork has a friction coefficient of between about 0.20μ and 0.40μ.

16. A filtering assembly for enhancing lighting from a luminaire, the assembly comprising: multiple stackable and interchangeable filter devices including: a body having a clear section configured to allow full passage of light, the body further having an opaque section configured to allow partial or no passage of light, whereby the filter devices have a differently sized and dimensioned clear sections and opaque sections; and an outer rim disposed along the periphery of the body, the outer rim having a cork material, the cork material defined by a friction coefficient, whereby the cork material restricts slippage between a stacked arrangement of filter devices, whereby at least one of the filter devices overlays a luminaire, the luminaire comprising a light source configured to transmit light.

17. The assembly of claim 16, wherein the body of the filter devices is disposed in a parallel, adjacent relationship with the luminaire and the outer rim of the filter devices engages a recessed perimeter of the luminaire.

18. The assembly of claim 16, wherein the cork material of the outer rim helps restrict slippage with the recessed perimeter of the luminaire.

19. A filtering assembly for enhancing lighting from a luminaire, the assembly comprising:

multiple stackable and interchangeable filter devices including: a body having a clear section configured to allow full passage of light, the body further having an opaque section configured to allow partial or no passage of light, whereby the filter devices have a differently sized and dimensioned clear sections and opaque sections; an outer rim disposed along the periphery of the body, the outer rim having a cork material, the cork material defined by a friction coefficient, whereby the cork material restricts slippage between a stacked arrangement of filter devices; a luminaire comprising a light source configured to transmit light, the luminaire further comprising a lens having a recessed perimeter, the lens enabling at least partial passage of the light, whereby at least one of the filter devices overlays the luminaire, whereby the body of the filter devices is disposed in a parallel, adjacent relationship with the luminaire, whereby the outer rim of the filter devices engages the recessed perimeter of the luminaire, such that the friction enhancing material of the outer rim helps restrict slippage with the recessed perimeter of the luminaire; and multiple micro ball bearings disposed along the outer rim, the micro ball bearings enabling the body to rotate freely about the lens of the luminaire.

* * * * *